US007137793B2

(12) United States Patent
Shafer et al.

(10) Patent No.: US 7,137,793 B2
(45) Date of Patent: Nov. 21, 2006

(54) MAGNETICALLY DRIVEN GEAR PUMP

(75) Inventors: Clark J. Shafer, Bolingbrook, IL (US); William R. Blankemeier, Oak Park, IL (US)

(73) Assignee: PeopleFlo Manufacturing, Inc., Franklin Park, IL (US)

( * ) Notice: Subject to any disclaimer, the term of this patent is extended or adjusted under 35 U.S.C. 154(b) by 439 days.

(21) Appl. No.: 10/818,510

(22) Filed: Apr. 5, 2004

(65) Prior Publication Data

US 2005/0220653 A1 Oct. 6, 2005

(51) Int. Cl.
*F04B 17/00* (2006.01)
*F01C 1/10* (2006.01)
*F16H 1/06* (2006.01)

(52) U.S. Cl. ..... 417/420; 418/169; 418/171

(58) Field of Classification Search ..... 417/420; 418/166–171; 74/413
See application file for complete search history.

(56) References Cited

U.S. PATENT DOCUMENTS 2,753,731 A * 7/1956 McWethy ..... 74/443
2,970,548 A 2/1961 Berner
3,015,282 A * 1/1962 Camarata ..... 418/102
3,465,681 A 9/1969 Zimmermann
3,520,642 A 7/1970 Fulton
4,044,567 A 8/1977 Dix et al.
4,065,235 A 12/1977 Furlong et al.
4,111,614 A 9/1978 Martin et al.
4,127,365 A 11/1978 Martin et al.
4,135,863 A 1/1979 Davis et al.
4,152,099 A 5/1979 Bingler
4,615,662 A 10/1986 Laing
4,722,661 A 2/1988 Mizuno
4,752,194 A 6/1988 Wienen et al.
4,822,256 A 4/1989 Laing
5,090,944 A 2/1992 Kyo et al.
5,165,868 A 11/1992 Gergets et al.
5,263,829 A 11/1993 Gergets
5,423,661 A 6/1995 Gabeler et al.
5,431,340 A 7/1995 Schirpke et al.
5,464,333 A 11/1995 Okada et al.
5,494,416 A * 2/1996 Gergets ..... 417/420
5,525,039 A 6/1996 Sieghartner
5,540,567 A 7/1996 Schirpke et al.
5,641,275 A 6/1997 Klein et al.
5,708,313 A 1/1998 Bowes et al.
5,763,973 A 6/1998 Cramer (Continued)

FOREIGN PATENT DOCUMENTS

JP 3074599 3/1991

OTHER PUBLICATIONS

Tuthill Pump Group Service Manual #67 for Magnetically Coupled Pumps.

(Continued)

*Primary Examiner*—Charles G. Freay
(74) *Attorney, Agent, or Firm*—Hanley, Flight & Zimmerman, LLC

(57) ABSTRACT

A magnetically driven gear pump having a housing, a rotatable annular magnetic drive assembly magnetically coupled to but spaced from an annular driven magnet and rotor gear assembly with an annular canister disposed therebetween, and wherein when the annular magnetic drive assembly is rotated, the annular driven magnet and rotor gear assembly rotate on a first shaft portion of an offset stationary shaft and the rotor gear drives an idler gear that rotates on a second shaft portion of the offset stationary shaft.

20 Claims, 5 Drawing Sheets

U.S. PATENT DOCUMENTS

| | | | | |
|---|---|---|---|---|
| 5,895,203 | A | 4/1999 | Klein | |
| 6,039,827 | A | 3/2000 | Cramer | |
| 6,135,728 | A | 10/2000 | Klein et al. | |
| 6,179,568 | B1 | 1/2001 | Phillips et al. | |
| 6,264,440 | B1 | 7/2001 | Klein et al. | |
| 6,293,772 | B1 | 9/2001 | Brown et al. | |
| 6,443,710 | B1 | 9/2002 | Tatsukami et al. | |
| 6,506,034 | B1 | 1/2003 | Lentz et al. | |
| 6,607,370 | B1 * | 8/2003 | Fukamachi et al. | 417/420 |
| 6,749,409 | B1 * | 6/2004 | Fukamachi et al. | 417/420 |
| 2002/0028147 | A1 | 3/2002 | Gabrieli et al. | |
| 2002/0041814 | A1 | 4/2002 | Casper et al. | |
| 2002/0085933 | A1 | 7/2002 | Fukamachi et al. | |
| 2004/0013546 | A1 | 1/2004 | Klein et al. | |

OTHER PUBLICATIONS

DESMI Operation and Service Manual for Rotan Pump Type ED.

* cited by examiner

MAGNETICALLY DRIVEN GEAR PUMP

BACKGROUND OF THE INVENTION

1. Field of the Invention

The present invention generally relates to positive displacement gear pumps, and more particularly to a magnetically driven gear pump of simplified construction having a magnet and rotor assembly and an offset stationary shaft on which two respective gears rotate.

2. Discussion of the Prior Art

In many pumping applications, it is desirable to avoid potential seal leakage by not using seals in conjunction with rotating parts. Accordingly, it has become more common in the pump arts to employ a magnetic drive system to eliminate the need for seals along rotating surfaces. While such pumps may still employ static seals, because of their lack of dynamic or rotational seals, they have become known as a "sealless" pump. Indeed, magnetic drive structures have been used in the design of positive displacement gear pumps as well.

In some prior art magnetically driven gear pumps, it is common to have a driven shaft on which is mounted at least one of the gears, generally referred to as a rotor. In turn, to support such a rotatable shaft, it is common to use an additional pump housing section or bracket between the magnetic drive components and the portion of the pump housing that contains the gears. Such pumps also tend to have the second or idler gear rotate on a fixed shaft. The fixed shaft may be mounted at one end within the head of the pump housing.

In the prior art pumps, the bracket that is needed to support the rotatable shaft for the rotor, along with the extra length of components including the rotatable shaft, add to the overall length and weight of such pumps. Moreover, the separate rotating rotor shaft and stationary shaft for the idler gear add to the complexity of the structures and tolerances necessary to make a successful, reliable pump. It would be desirable to simplify and reduce the size and weight of such magnetically driven gear pumps.

The present invention addresses shortcomings in prior art gear pumps, while providing the above mentioned desirable features in magnetically driven gear pumps.

SUMMARY OF THE INVENTION

The purpose and advantages of the invention will be set forth in and apparent from the description and drawings that follow, as well as will be learned by practice of the invention.

The present invention is generally embodied in a magnetically coupled gear pump which has a pump housing having an inlet and an outlet, a rotatable annular magnetic drive assembly disposed in the pump housing and having a recess at one end, an annular canister having a recess at one end, having at least a portion of the canister disposed within the recess of the annular magnetic drive assembly, and having a peripheral edge in sealing engagement with the pump housing. The pump also has an annular driven magnet and rotor gear assembly having a magnetic portion disposed substantially within the recess of the annular canister, and the magnetic portion being substantially in alignment with the annular magnetic drive assembly and forming a coupled drive arrangement.

In a first aspect of the invention, the pump has an offset stationary shaft having first and second shaft portions with a longitudinal axis of the first shaft portion being parallel to but spaced from a longitudinal axis of the second shaft portion, wherein when the rotatable annular magnetic drive assembly is rotated, the annular driven magnet and rotor gear assembly rotate on the first shaft portion of the offset stationary shaft and the rotor gear drives an idler gear that rotates on the second shaft portion of the offset stationary shaft.

In another aspect of the invention, the offset stationary shaft may be supported only at an end of the first shaft portion within the recess in the annular canister, or only at an end of the second shaft portion in a head portion of the pump housing, or both at an end of the first shaft portion within the recess in the annular canister and at an end of the second shaft portion in a head portion of the pump housing.

In a further aspect of the invention, the annular driven magnet and rotor gear assembly has a rotor gear portion integrally formed with a magnet mounting portion.

In still another aspect of the invention, the offset stationary shaft may be formed of one continuous piece or may be formed of at least two components connected together.

Thus, the present invention presents an alternative to the longer, more complicated magnetically driven gear pumps that required an additional bracket portion of the pump housing between the magnetic drive components and the rotor gear. The present invention also simplifies the structures by utilizing an offset stationary shaft for the rotor gear and an idler gear, as opposed to having the gears rotate on two separate stationary shafts or rotate with two rotating shafts.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While considerable mechanical details of a magnetically driven gear pump, including details of fastening means and other plan and section views of the particular components, have been omitted, such details are considered well within the comprehension of those skilled in the art in light of the present disclosure. It also should be understood that the present invention is not limited to the preferred embodiments illustrated.

DETAILED DESCRIPTION OF THE PREFERRED EMBODIMENTS

Referring generally to FIGS. 1–6*a*, it will be appreciated that the magnetically driven gear pump of the present invention generally may be embodied within numerous configurations of a sealless positive displacement gear pump.

Figure 1:
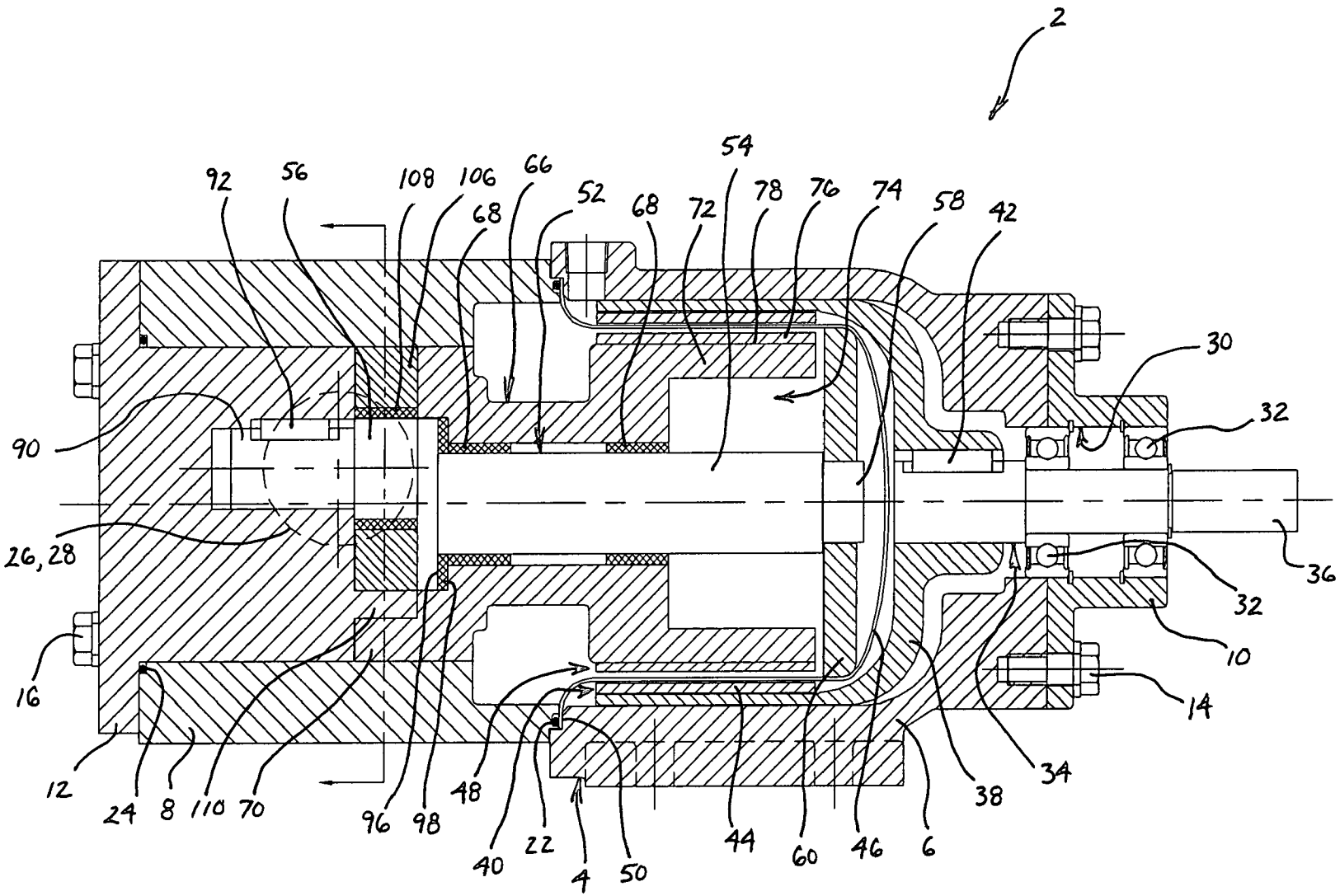
FIG. 1 is a cross-sectional view of a magnetically driven gear pump having an offset stationary shaft supported within an annular canister and in the head of the pump housing.
Figure 2:
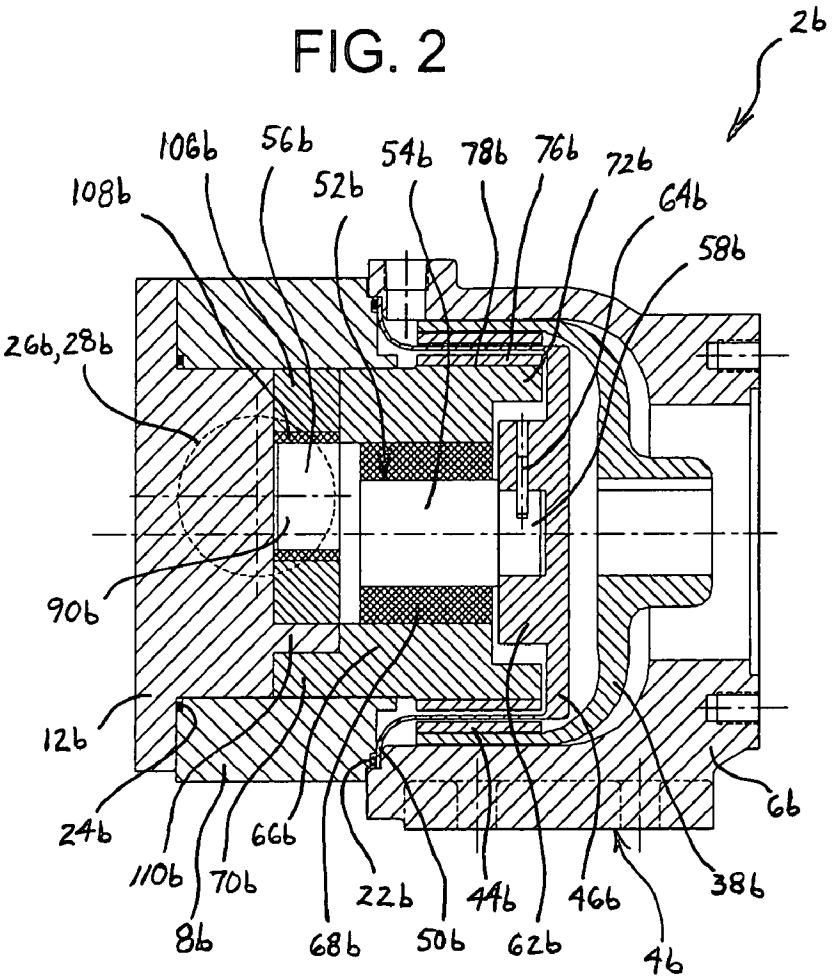
FIG. 2 is a cross-sectional view of a magnetically driven gear pump having a highly compact magnet and rotor gear assembly and an offset stationary shaft only supported within an annular canister.
Figure 1A:
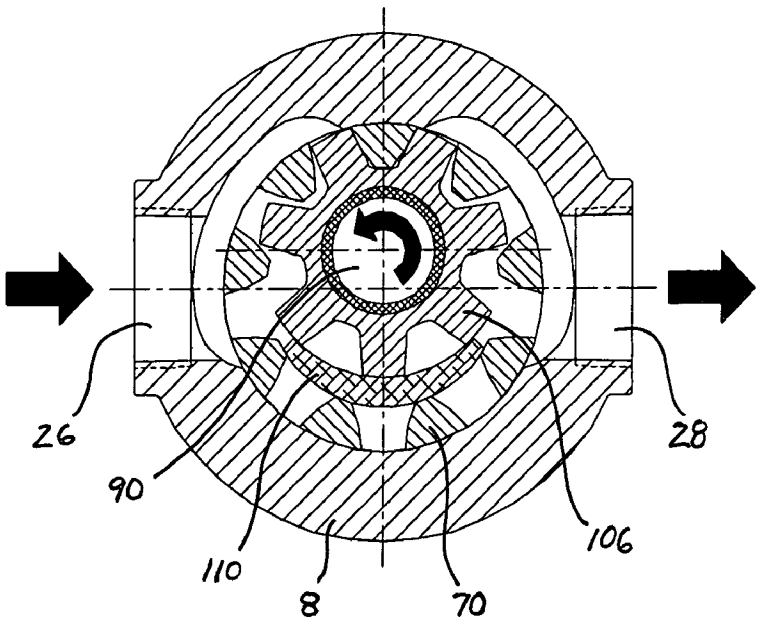
FIG. 1*a* is a cross-sectional view of the pump of FIG. 1, taken through the section line shown in FIG. 1.
Figure 3:
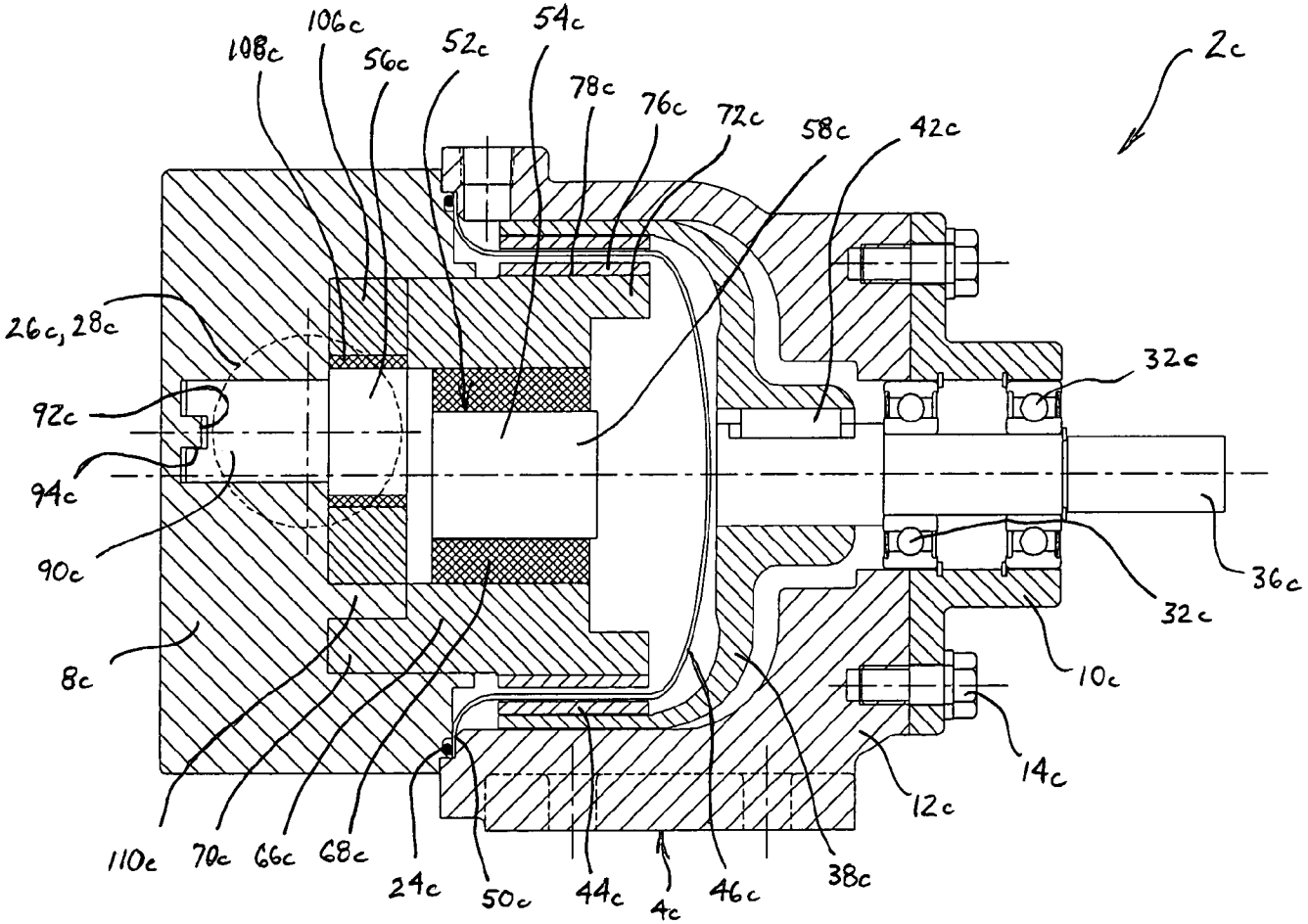
FIG. 3 is a cross-sectional view of a magnetically driven gear pump having a highly compact magnet and rotor gear assembly, a simplified annular canister and an offset stationary shaft only supported in the head of the pump housing.

Referring to a preferred embodiment in FIG. 1, a pump 2 has a housing 4 that includes a first body portion 6, a second body portion 8, a bearing cap 10 connected to the first body portion 6 and a head 12 connected to the second body portion 8. The housing components may be constructed of rigid materials, such as steel, stainless steel, cast iron or other metallic materials, or structural plastics or the like. Bearing cap 10 is connected to first body portion 6 by bolts 14, although it will be appreciated that such connection may be by other fastening means, or by direct connection of the components, such as by press fit or by threaded engagement. Alternatively, bearing cap 10 and first body portion 6 may be integrally formed as one piece. Housing head 12 is connected to second body portion 8 in a similar manner by bolts 16, and may also be connected by any one of many other suitable constructions. Static seals 22 and 24, such as elastomeric o-rings, preformed or liquid gasket materials or the like, may be employed to enhance the connections between the housing components. Housing 4 also has an inlet 26 for drawing the fluid or medium to be pumped into housing 4, and an outlet 28 for expelling the medium from the pump. FIGS. 1, 2 and 3 show cross-sections through the preferred embodiments at 90° to inlet 26 and outlet 28 which are aligned. FIG. 1*a* shows inlet 26 and outlet 28 in second body portion 8. It will be appreciated that inlet 26 and outlet 28 may be arranged at any angle relative to each other, and that pump 2 may have more than one inlet and more than one outlet.

Bearing cap 10 has an opening 30 in which bearings 32 are mounted to support rotatable annular magnetic drive assembly 34. Bearings 32 may be of various constructions, such as ball or roller bearings, bushings or the like. Drive assembly 34 includes shaft 36 which rotatably engages bearings 32, and which may be coupled at a first end to an external power source (not shown), such as a motor or the like. Rotatable annular magnetic drive assembly 34 also includes a cup-shaped drive member 38 connected at its first end to the second end of rotatable shaft 36 and having a recess 40 at a second end. Alternatively, bearing cap 10, bearings 32 and shaft 36 may be eliminated in favor of mounting cup-shaped drive member 38 directly on the shaft of an external power source (as would be accommodated in the alternative embodiment in FIG. 2). The connection of drive member 38 to shaft 36 is shown as by a key and keyway 42, although it will be appreciated that such connection may be by alternative means such as noted above with respect to the connection of pump housing portions. Similarly, drive member 38 and shaft 36 may be integrally formed as one piece. Drive member 38 may be constructed of a rigid material, such as that discussed in relation to the housing. Drive assembly 34 also has magnets 44 connected to the inner walls of cup-shaped drive member 38 within recess 40. Magnets 44 may be of any configuration, but are preferably rectangular and are preferably connected to drive member 38 by chemical means, such as by epoxy or adhesives, or may be attached by suitable fasteners, such as by rivets or the like.

Disposed at least partially within recess 40 of annular magnetic drive assembly 34 is a cup or bell-shaped canister 46. Canister 46 may be constructed of any of a variety of rigid materials, and the material is typically chosen based on the medium to be pumped, but is preferably of stainless steel, such as alloy C-276, but also may be of plastic, composite materials or the like. Canister 46 is open at one end forming a recess 48 and has a peripheral rim 50. Peripheral rim 50 of canister 46 may be mounted in sealing engagement to pump housing 4 in various ways, one of which is shown in FIG. 1 where it is mounted to first body portion 6 at the connection between first body portion 6 and second body portion 8.

The magnetically driven gear pump 2 includes an offset stationary shaft 52 having a first shaft portion 54 having a first longitudinal axis, and a second shaft portion 56 having a second longitudinal axis parallel to but spaced from the longitudinal axis of the first shaft portion. The first shaft portion 54 extends within recess 48 of canister 46 and may be supported at that respective end 58 of first shaft portion 54 of offset shaft 52. Support may be provided to shaft end 58 by engaging a support member 60 disposed in the recess 48 of canister 46, as shown in FIG. 1.

Figure 4:
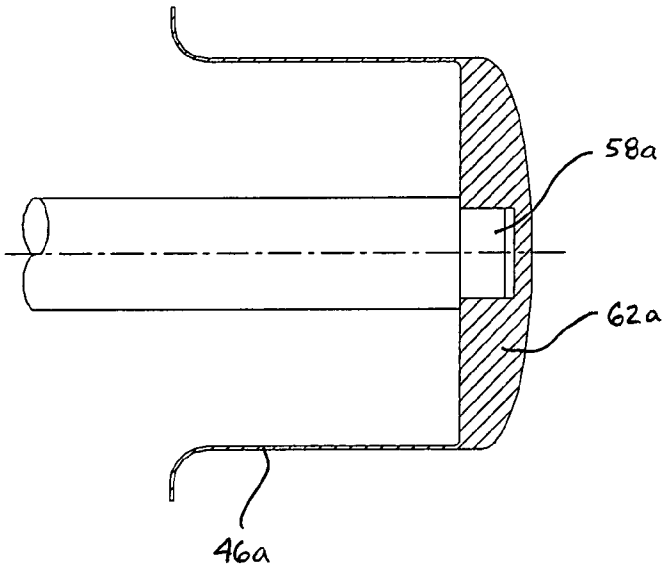
FIG. 4 is a cross-sectional view of an alternative integral support for an end of the offset stationary shaft within the canister.

Alternatively, if the first shaft portion end is to be supported in the canister, the canister may have an integral support portion 62*a*, such as is shown in FIG. 4 in canister 46*a*, where the shaft end 58*a* is merely supported by the integral support portion 62*a*, or is fixedly connected to the integral support portion 62*a*, such as by press fit or chemical bonding agents. In still a further alternative shown in FIG. 2, a compact canister 46*b* may have a more substantial support portion 62*b* that is integral with, or separate but fixedly connected to, canister 46*b*, to support offset shaft 52*b* at shaft end 58*b*. Also, shaft end 58*b* may be fixedly connected to canister 46*b* by the above-mentioned means or by a fastener 64*b* such as a press fit pin, a screw or the like. Fixed connection within a support portion in the canister also may serve to establish and maintain alignment of the offset stationary shaft.

In the preferred embodiment in FIG. 1, the pump 2 also includes an annular driven magnet and rotor gear assembly 66 which rotatably engages first shaft portion 54 of offset shaft 52 and may employ friction reducing means such as bushings 68, or other suitable bearing structures. Magnet and rotor gear assembly 66 has a rotor gear portion 70 disposed toward the second shaft portion 56, and a magnet mounting portion 72 connected to the rotor gear portion 70 either integrally, or by suitable means of fixedly joining the components. The rotor gear portion 70 may be of various constructions, such as in the form of an outer gear of an internal gear pump. The rotor gear portion 70 also may be constructed of various rigid materials, depending on the medium to be pumped. For instance, it may be preferable to make the rotor gear portion 70, as well as the magnet mounting portion of steel when such a pump is intended for use in pumping non-corrosive materials.

The magnet mounting portion 72 preferably has a recess 74 in its end for weight and inertia reduction. Magnet mounting portion 72 also has magnets 76, similar to magnets 44, connected to its outer wall 78, preferably in a similar manner to that employed to connect magnets 44 to drive member 38. When pump 2 is made for use in pumping corrosive materials, it is preferable to make the magnet and rotor gear assembly 66 of stainless steel, but it is advantageous to include an annular carbon steel portion (not shown) between the magnet mounting portion 72 and magnets 76. A stainless steel sleeve (not shown) may be mounted over the magnets and annular carbon steel portion for further protection. Magnet mounting portion 72 and magnets 76 are disposed within recess 48 of canister 46, so as to be separated from magnets 44 of annular magnetic assembly 34 by annular canister 46, but they are arranged to place the respective magnets 76 and 44 in substantial alignment to form a magnetic coupling. This magnetic coupling allows annular magnet and rotor gear assembly 66 to have no physical contact with but be rotated and thereby driven by rotation of annular magnetic drive assembly 34.

Figure 6:
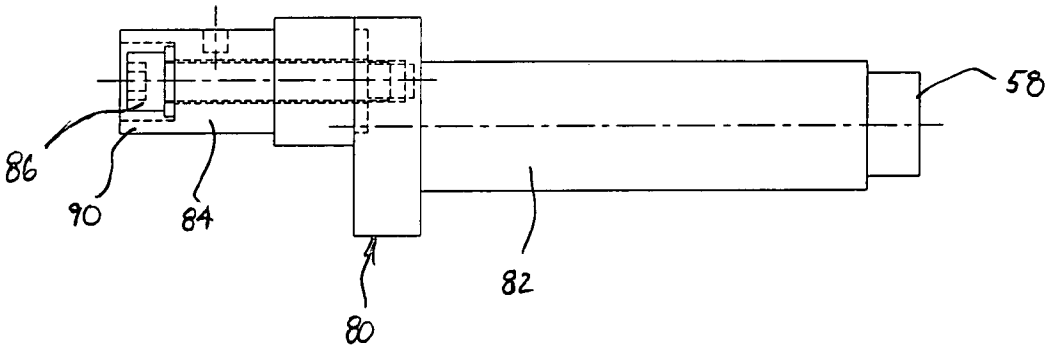
FIG. 6 is a plan view of an alternative offset stationary shaft of multi-piece construction.
Figure 6A:
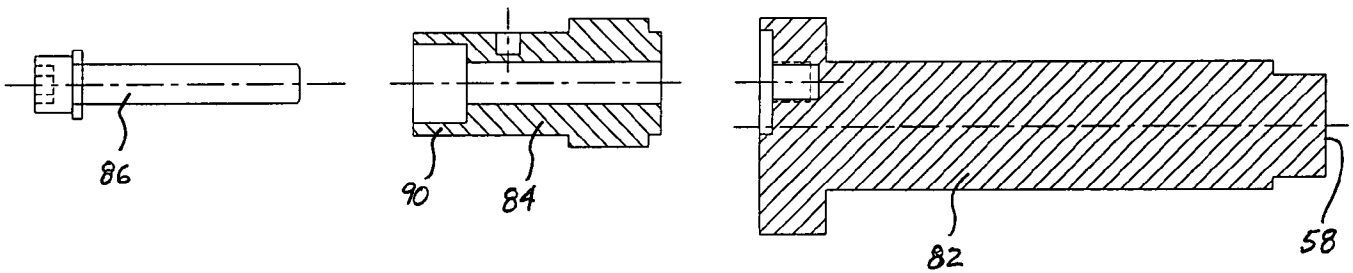
FIG. 6*a* is a cross-sectional, exploded view of the offset stationary shaft shown in FIG. 6.

As previously noted, offset stationary shaft 52 includes a second shaft portion 56. As shown in the preferred embodiments in FIGS. 1–3, offset shaft 52 may be of continuous construction with an integral first shaft portion 54 and second shaft portion 56. However, offset shaft 52 may be constructed in various alternative ways, one example of which is shown in FIGS. 6 and 6*a*. FIG. 6 shows a multi-piece offset shaft 80 having a first shaft portion 82 that is fixedly connected to a second shaft portion 84. The connection may be made via a bolt 86, as is shown in FIGS. 6 and 6*a*, or may be made by using other fasteners or means of attachment, such as welding, press fitting or the like.

Second shaft portion 56 (or 84) has an end 90, which is opposite shaft end 58 of first shaft portion 54. It will be appreciated that as was discussed with respect to shaft end 58, support for shaft 52 may be provided to shaft end 90. Support for shaft end 90 is shown, for instance, in FIG. 1, where shaft end 90 is supported in housing head 12. In this arrangement, alignment of offset shaft 52 is established and rotation is prevented by using a key and keyway 92.

As shown in the alternative embodiment in FIG. 2, cup-shaped drive member 38*b* may directly receive a shaft of an external power source. Also, the shaft end 90*b* of second shaft portion 56*b* may not include a further portion supported in a housing head 12*b*. Indeed, as discussed above, offset stationary shaft 52*b* is fixedly supported at shaft end 58*b* in canister 46*b*. This construction permits a simplified structure for housing head 12*b*, and may permit further simplification by incorporating the housing head into the second housing body. The second embodiment in FIG. 2 also permits use of a compact annular driven magnet and rotor gear assembly 66*b*, with friction reducing bushings or bearings 68*b*. This compact design may be used in a pump 2*b* of still shorter length.

Such incorporation of the housing head into the second housing body 8*c* is shown in a third preferred embodiment in FIG. 3. This embodiment also provides an example of an alternative support structure for the offset stationary shaft. In FIG. 3, alternative offset stationary shaft 52*c* has a first shaft portion 54*c* with a first shaft end 58*c* and a second shaft portion 56*c* with a second shaft end 90*c*. Offset shaft 52*c* is supported at shaft end 90*c* within the integrated housing second portion and head 8*c*, but not at shaft end 58*c* within canister 46*c*. Shaft end 90*c* is fixedly connected to housing portion 8*c* by any of the above-mentioned means, while alignment and resistance to rotation are further provided by a raised rib or tang 92*c* in housing portion 8*c* and a corresponding slot 94*c* in shaft end 90*c* of second shaft portion 56*c*. Somewhat similarly to the second embodiment in FIG. 2, the third embodiment in FIG. 3 uses a compact annular driven magnet and rotor gear assembly 66*c* with friction reducing bushings or bearings 68*c*, in a shortened pump 2*c*.

Figure 5:
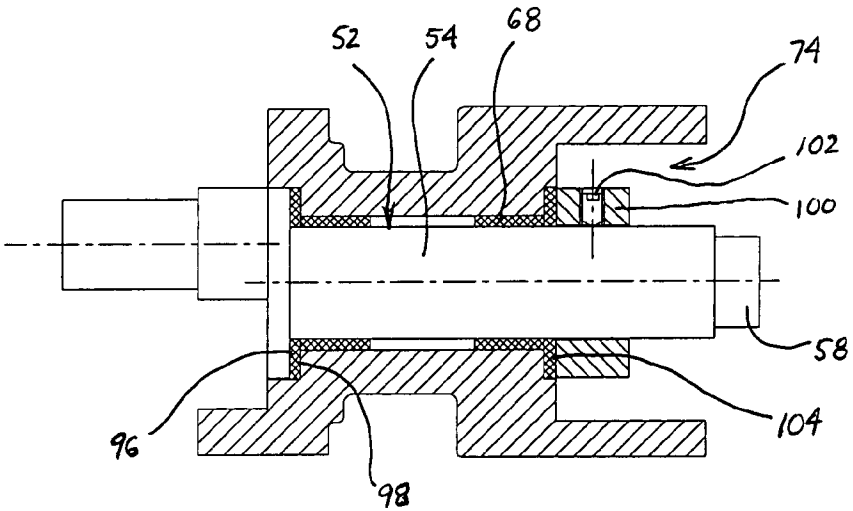
FIG. 5 is a cross-sectional view of an alternative annular driven magnet and rotor assembly having a rotor gear and a magnet mounting portion, shown with a separate thrust bearing and without the magnets.

It is desirable for annular driven magnet and rotor gear assembly 66 also to have some form of thrust bearing surfaces. As is shown in FIG. 1, a forward thrust bearing surface 96 may be integrally provided on offset stationary shaft 52, to engage a forward thrust bearing member 98 located in magnet and rotor gear assembly 66. Additional provision for rearward thrust bearings may be employed, such as in the form of the separate collar 100 shown in FIG. 5. Collar 100 may be mounted to first shaft portion 54 of offset stationary shaft 52 in vary ways. FIG. 5 shows a mounting by set screw 102, although other fasteners or means of joining a collar to a shaft, such as press fitting and the like, may be employed. Collar 100 is arranged to engage a rearward thrust bearing member 104 located at the other end of magnet and rotor gear assembly 66, within recess 74. Thus, thrust bearings may integrally or separately provided to retain appropriate positioning of components and thereby reduce vibration and wear.

In each of the respective embodiments shown, mounted for rotation on the second shaft portion is an idler gear 106. Friction reducing means, such as bushing 108 or bearings, may be used. Idler gear 106 is arranged to engage rotor gear portion 70 via a meshing of gear teeth on idler gear 106 and on rotor gear portion 70, as best seen in FIG. 1*a*. In operation of pump 2, as the external power source rotates annular magnetic drive assembly 34, the magnetic coupling discussed above causes annular driven magnet and rotor gear assembly 66 to rotate. Rotation of magnet and rotor gear assembly 66 and the intermeshing of the teeth of rotor gear portion 70 with the teeth of idler gear 106 causes idler gear 106 to rotate as well. With pump 2 arranged as an internal gear pump, as is well known in the art, the axis of rotation of rotor gear portion 70 is parallel to and spaced from the axis of rotation of idler gear 106, as shown in FIG. 1. Also, rotor gear portion 70 is arranged to drive idler gear 106 by engagement with gear teeth on the inside of rotor gear portion 70, which essentially circumscribes idler gear 106, as best seen in FIG. 1*a*. This arrangement and meshing of gears along with a crescent-shaped protrusion 110 on housing head portion 12 and positioned adjacent the tips of the teeth on idler gear 106 cooperate to create the pumping action by well known principles. In this arrangement, the medium to be pumped is drawn into pump 2 through inlet 26 and is expelled under pressure from outlet 28.

It will be appreciated that a magnetically driven gear pump in accordance with the present invention may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such a pump without departing from the scope or spirit of the present invention, and that the claims are not limited to the preferred embodiments illustrated.

What is claimed is:

1. A magnetically coupled gear pump comprising:

a pump housing having at least one inlet and at least one outlet;

a rotatable annular magnetic drive assembly disposed in the pump housing and having a recess at one end;

an annular canister having a recess at one end, having at least a portion of the canister disposed within the recess of the rotatable annular magnetic drive assembly, and being in sealing engagement with the pump housing;

an annular driven magnet and rotor gear assembly having a magnetic portion disposed substantially within the recess of the annular canister, and the magnetic portion being substantially in magnetic alignment with the rotatable annular magnetic drive assembly;

an offset stationary shaft having first and second shaft portions with a longitudinal axis of the first shaft portion being parallel to but spaced from a longitudinal axis of the second shaft portion; and wherein when the rotatable annular magnetic drive assembly is rotated, the annular driven magnet and rotor gear assembly rotate on the first shaft portion of the offset stationary shaft and the rotor gear drives an idler gear that rotates on the second shaft portion of the offset stationary shaft.

2. A magnetically coupled gear pump in accordance with claim 1, wherein at least a portion of the first shaft portion of the offset stationary shaft extends within the annular canister.

3. A magnetically coupled gear pump in accordance with claim 2, wherein the first shaft portion of the offset stationary shaft is supported at one end within the recess of the annular canister.

4. A magnetically coupled gear pump in accordance with claim 3, further comprising a shaft support mounted within the recess of the annular canister.

5. A magnetically coupled gear pump in accordance with claim 3, wherein the recess of the annular canister further comprises an integral support for an end of the first shaft portion of the offset stationary shaft.

6. A magnetically coupled gear pump in accordance with claim 1, wherein the pump housing further comprises a head portion and the second shaft portion of the offset stationary shaft is supported at one end in the head portion of the pump housing.

7. A magnetically coupled gear pump in accordance with claim 6, wherein the first shaft portion of the offset stationary shaft is supported within the recess of the annular canister and the second shaft portion of the offset stationary shaft is supported in the head portion of the pump housing.

8. A magnetically coupled gear pump in accordance with claim 1, wherein the annular driven magnet and rotor gear assembly further comprises a rotor gear portion connected to a magnet mounting portion.

9. A magnetically coupled gear pump in accordance with claim 1, wherein the annular driven magnet and rotor gear assembly further comprises a rotor gear portion integrally formed with a magnet mounting portion.

10. A magnetically coupled gear pump in accordance with claim 8, wherein the annular driven magnet and rotor gear assembly further comprises magnets connected to the magnet mounting portion.

11. A magnetically coupled gear pump in accordance with claim 9, wherein the annular driven magnet and rotor gear assembly further comprises magnets connected to the magnet mounting portion.

12. A magnetically coupled gear pump in accordance with claim 1, wherein the offset stationary shaft further comprises at least one thrust bearing surface.

13. A magnetically coupled gear pump in accordance with claim 1, wherein the rotatable annular magnetic drive assembly is mounted on a shaft that is rotatably mounted in the pump housing.

14. A magnetically coupled gear pump in accordance with claim 1, wherein the rotatable annular magnetic drive assembly is adapted to be mounted on a rotatable shaft of an external power source.

15. A magnetically coupled gear pump in accordance with claim 1, wherein the idler gear is disposed within the rotor gear and driven by the rotor gear in an internal gear pump configuration.

16. A magnetically coupled gear pump in accordance with claim 15, wherein the pump housing further comprises a crescent adjacent the idler gear.

17. A shaft and gear assembly of a magnetically coupled gear pump comprising an offset stationary shaft further comprising a first shaft portion having a first longitudinal axis and a second shaft portion having a second longitudinal axis, said first and second longitudinal axes being parallel and spaced apart from each other, and further comprising a rotor gear rotatably engaging the first shaft portion, an idler gear rotatably engaging the second shaft portion and the rotor gear engaging the idler gear.

18. A shaft and gear assembly of a magnetically coupled gear pump in accordance with claim 17, wherein the offset stationary shaft is formed of one continuous piece.

19. A shaft and gear assembly of a magnetically coupled gear pump in accordance with claim 17, wherein the offset stationary shaft further comprises at least two components connected together.

20. A shaft and gear assembly of a magnetically coupled gear pump in accordance with claim 17, wherein the rotor gear further comprises a magnet assembly.

* * * * *